United States Patent [19]

Kallikounis

[11] 3,953,926

[45] May 4, 1976

[54] HAIR CUTTING AND TRIMMING DEVICE

[76] Inventor: James D. Kallikounis, 28024 Santona Drive, Palos Verdes Peninsula, Calif. 90274

[22] Filed: Feb. 11, 1975

[21] Appl. No.: 548,981

[52] U.S. Cl. ..... 30/31; 30/320

[51] Int. Cl.[2] ..... B26B 21/12

[58] Field of Search ..... 30/30, 31, 54, 60, 60.5, 30/61, 63, 71, 84, 320

[56] References Cited

UNITED STATES PATENTS

| | | | |
|---|---|---|---|
| 1,358,442 | 11/1920 | Hasson | 30/30 |
| 1,918,636 | 7/1933 | Duffy | 30/31 |
| 1,951,775 | 3/1934 | Seilaz | 30/30 |
| 2,141,755 | 12/1938 | Kurkjian | 30/84 UX |
| 3,754,325 | 8/1973 | Tornvall | 30/30 |
| 3,855,695 | 12/1974 | Spanel | 30/30 |

*Primary Examiner*—Al Lawrence Smith
*Assistant Examiner*—Gary L. Smith
*Attorney, Agent, or Firm*—Marvin H. Kleinberg

[57] ABSTRACT

A hair cutting and trimming device for use by an individual includes a body portion constitution a carrier for a comb, the length of which is adjustable in relation to the body portion to control the length of cut of the hair, and a blade mounted on the body portion and in close proximity to the tines of the comb. The tines include notches or grooves to lift and guide the hair, enabling the blade effectively to shear off the hair at a predetermined length determined by the adjustment of the comb in relation to the body portion of the device.

13 Claims, 21 Drawing Figures

FIG. 1.
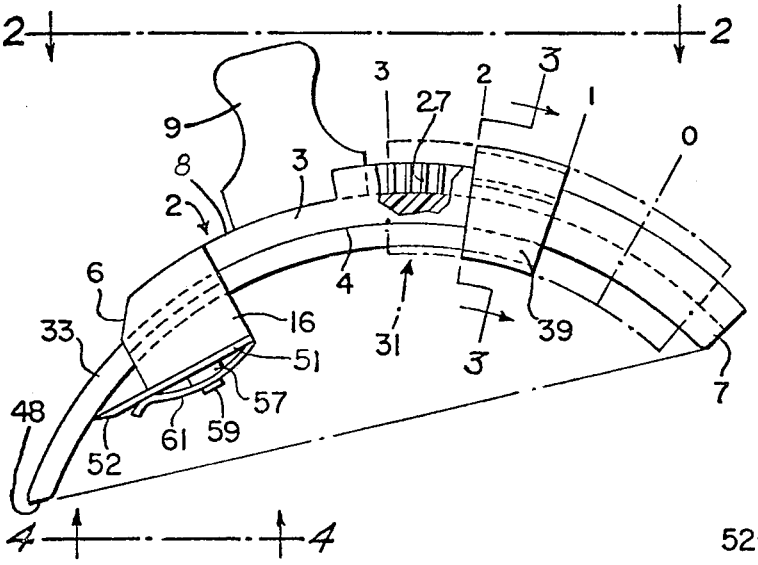
FIG. 5.
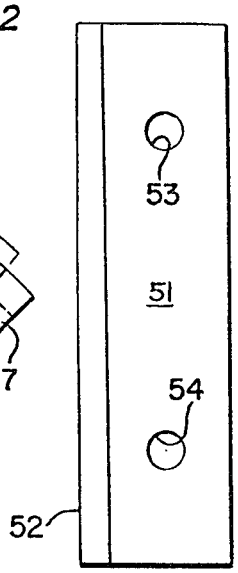
FIG. 6.
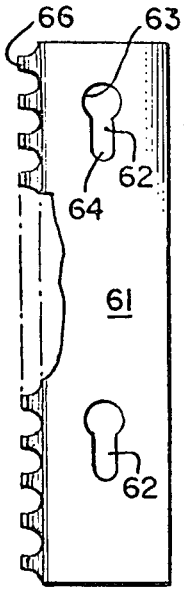
FIG. 2.
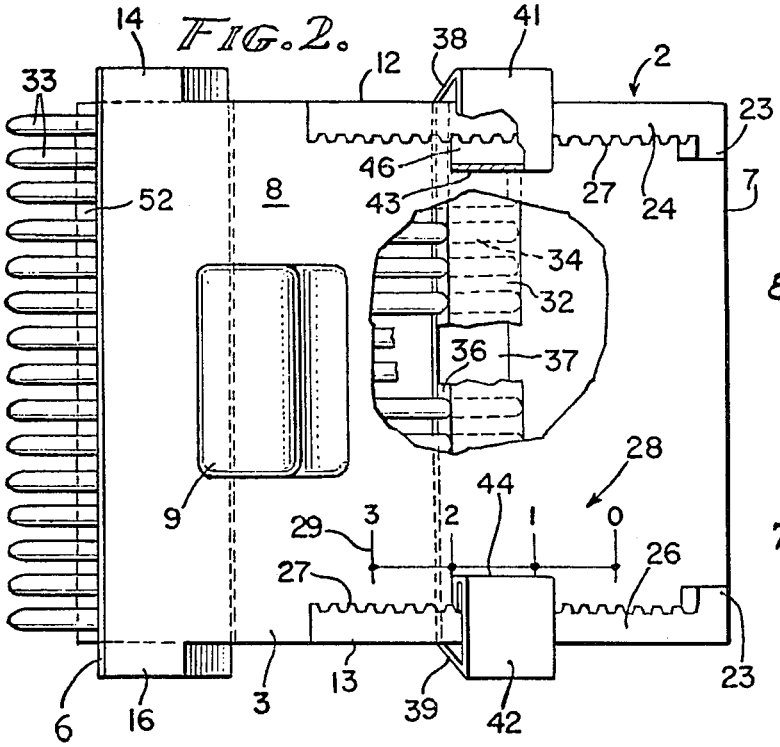
FIG. 4.
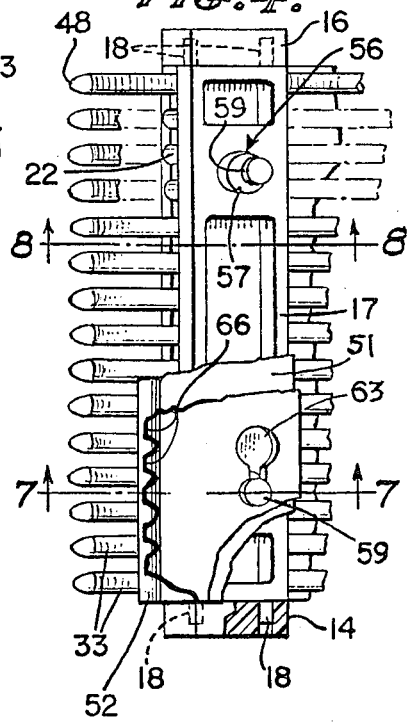
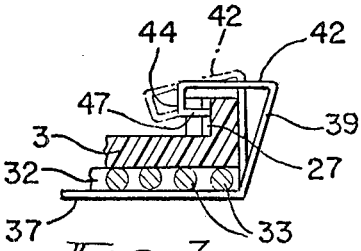
FIG. 3.

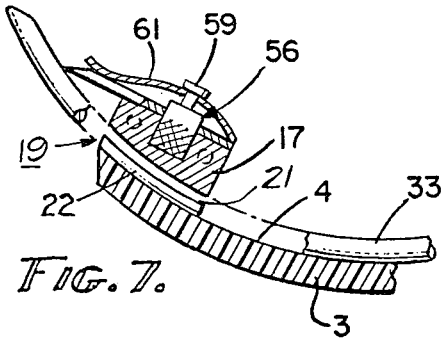
FIG. 7.
FIG. 8.
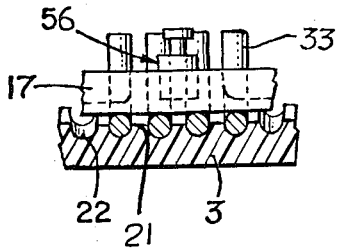
FIG. 9.
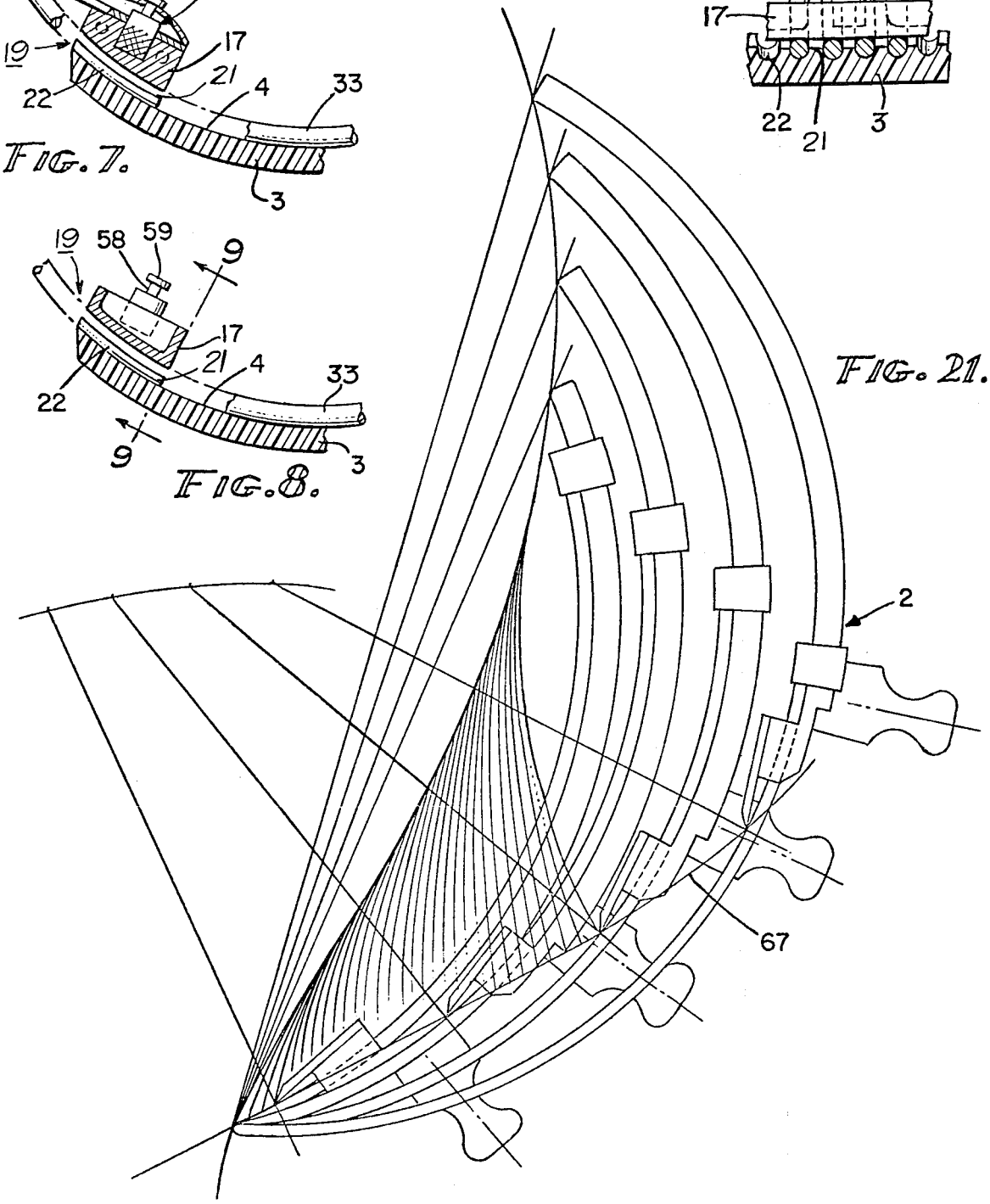
FIG. 21.

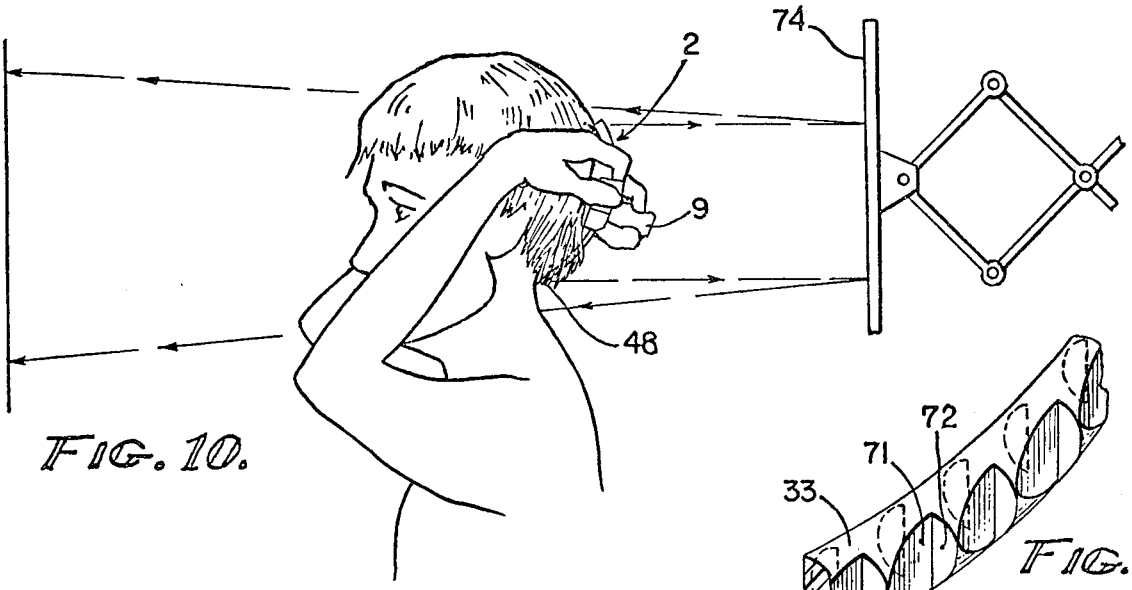
FIG. 10.
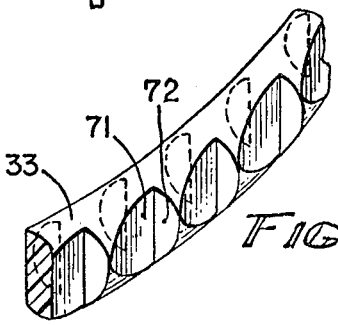
FIG. 12.
FIG. 11.
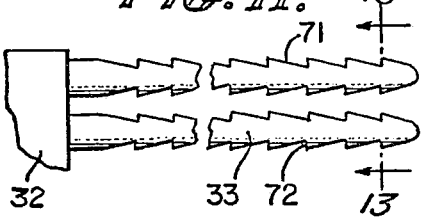
FIG. 13.
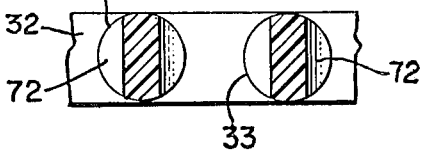
FIG. 14.
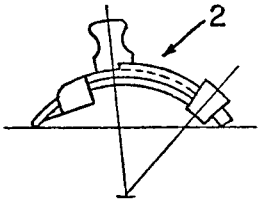
FIG. 15.
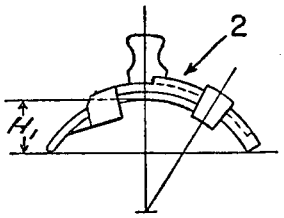
FIG. 16.
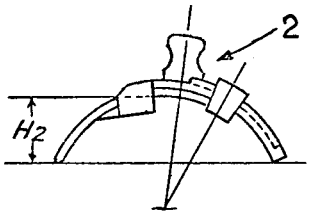
FIG. 17.
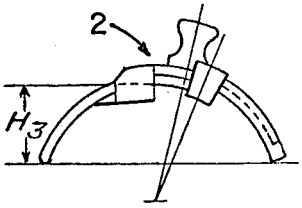
FIG. 18.
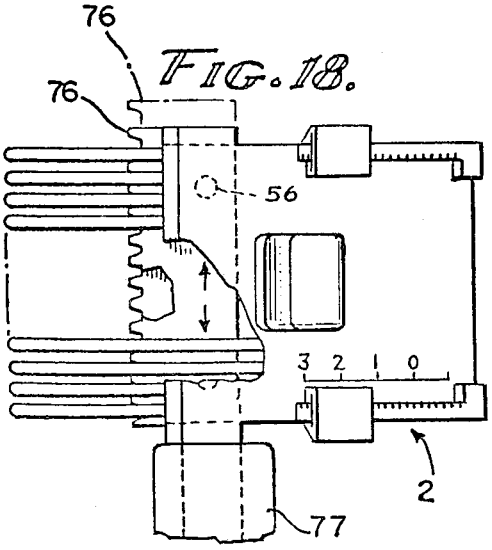
FIG. 19.
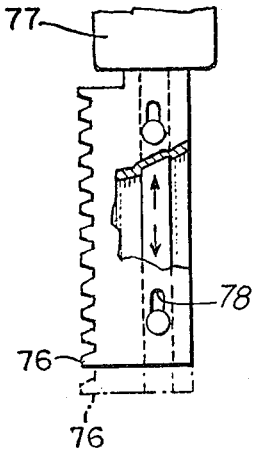
FIG. 20.
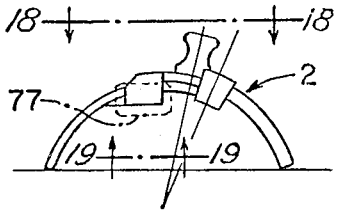

HAIR CUTTING AND TRIMMING DEVICE

BACKGROUND OF THE INVENTION

1. Field of the Invention

This invention relates to a device for cutting and trimming the hair on a person's head, which may be manipulated by the person himself without the need of going to a barber.

2. Description of the Prior Art

The prior art is replete with devices for the self-cutting of hair. Examples of such devices are illustrated in U.S. Pat. Nos. 913,005; 1,395,334; 1,471,970; 2,252,628; 2,602,219; 2,610,392; 2,610,393; 2,624,937; 2,636,261; 2,641,055; 2,661,529; 2,700,213; 2,716,809; 2,722,739; 2,896,320; 2,967,354; 3,289,295; 3,523,364; and 3,358,367. A careful review of these patents has failed to indicate a device having the limits of adjustability for controlling the length of hair cut by the user, and which simultaneously provides means for producing a taper to the mass of hair overlying the nape of the neck. Additionally, in none of the patents listed above has a device been disclosed which may be adjusted to effect a shaving cut of the hair below the nape of the neck, as is customary when a barber cuts a person's hair.

SUMMARY OF THE INVENTION

Accordingly, one of the objects of the invention is the provision of a hair cutting and trimming device which possesses the foregoing advantages.

Another object of the invention is the provision of a hair cutting and trimming device which is simple in its construction, uncomplicated in its operation, and economical to purchase, thus making it attractive to a maximum number of users.

Another object of the invention is the provision of a hair cutting and trimming device incorporating a cutting blade the height of which may be adjusted in relation to the scalp of the user so as to provide adjustment in the length of the hair that is cut.

Still another object of the invention is the provision of a hair cutting and trimming device which may incorporate a fixed blade adjustable to produce haircuts of different lengths, or which can accommodate a rapidly reciprocating, motor-driven blade which may also be set to produce haircuts of different lengths.

The hair of the human head has the natural tendency to have more or less oil. Because the head and the hair are normally exposed to the ambient atmosphere, dust particles in the air intermix with such oily substances in the hair to form impurities in the hair. Any type of hair dressing implement has the tendency to become contaminated by such impurities. Accordingly, a still further subject of the invention is the provision of hair cutting and trimming device which easily disassembles for purposes of cleaning so that it may always be maintained in a wholesome condition.

One of the problems that must be overcome in a hair cutting and trimming device is the need to elevate the hair with the tines of the comb as it is drawn through the hair. In most conventional devices, the tendency of the comb is to cause the hair to lay flat or close to the scalp as possible. It will, of course, be understood that this is the normal function of a comb or of combing one's hair. However, for purposes of cutting and trimming the hair, it is important that the hair be lifted so that it may be brought in contact with the blade. Accordingly, a still further object of the invention is the provision of a hair cutting and trimming device constructed in such a way that it will cause the hair to be elevated as the comb is drawn through the hair, and will retain the hair in elevated position while it is being cut by the cutting blade.

The invention possesses other objects and features of advantage, such of which, with the foregoing, will be apparent from the following description and drawings. It is to be understood, however, that the invention is not limited to the embodiment illustrated and described, since it may be embodied in various forms within the scope of the appended claims.

In terms of broad inclusion, the hair cutting and trimming device of the invention comprises a body portion constituting a carrier frame or plate, the body portion being provided with a handle and a concave surface on the side thereof opposite the handle. Mounted on the body portion is an arcuate comb adapted to lie against the concave surface of the body portion and to slide smoothly in relation thereto to effectively extend the arc formed by the concave surface when it is desired to adjust the length of the hair being cut.

Means are provided on the comb and body portion cooperating to selectively lock the body portion and comb in relation to each other to prevent inadvertent relative movement therebetween, while permitting adjustment of the comb in relation to the body portion when it is desired to adjust the height of the cutting blade. Means are also provided on the tines of the comb to effect elevation and retention of the hair as the comb is drawn through the hair, and means are provided associated with the body portion of the device to retain a blade fixed to the body and close proximity to the tines of the comb, or to retain a rapidly reciprocating motor-driven blade in the same position.

BRIEF DESCRIPTION OF THE DRAWINGS

FIG. 1 is a side elevational view partly broken away showing the hair cutting and trimming device according to the present invention;

FIG. 2 is a plan view partly broken away taken in the plane indicated by the line 2—2 of FIG. 1 in the direction of the appended arrows;

FIG. 3 is a fragmentary cross sectional view taken in the plane indicated by the line 3—3 of FIG. 1 in the direction of the appended arrows, showing, in enlarged detail, the means for locking the body portion and comb structure against relative movement;

FIG. 4 is a fragmentary view in bottom plan of the blade attachment means and blade taken in the plane indicated by the line 4—4 of FIG. 1 in the direction of the appended arrows;

FIG. 5 is a plan view of a typical blade.

FIG. 6 is a plan view of a blade locking plate;

FIG. 7 is a fragmentary sectional view of the structure of FIG. 4 taken in the plane indicated by the line 7—7 in the direction of the appended arrows;

FIG. 8 is a fragmentary sectional view of the structure of FIG. 4 taken in the plane indicated by the line 8—8 in the direction of the appended arrows;

FIG. 9 is a fragmentary sectional view of the structure of FIG. 8 taken in the plane indicated by the line 9—9 with direction of the appended arrows showing the tine guide means associated with the blade support bridge;

FIG. 10 is a perspective view illustrated use of the hair cutting and trimming device;

FIG. 11 is a fragmentary elevational view of two of the tines showing the hair elevation means thereon;

FIG. 12 is a fragmentary view, in perspective, of one of the tines, illustrating the hair elevation means formed therein;

FIG. 13 is a cross-sectional view of the tines of FIG. 11 taken in the plane indicated by the line 13—13 in the direction of the appended arrows;

FIG. 14 is a side elevational view illustrating the hair cutting and trimming device in its fully retracted position;

FIG. 15 is a side elevational view of the device shown readjusted to a second position;

FIG. 16 is a side elevational view similar to FIG. 15, but showing a third adjusted position of the blade;

FIG. 17 is a side elevational view of the device showing the comb extended to its extreme position in relation to the body portion of the device;

FIG. 18 is a plan view illustrating use of a motor and motor-driven cutting blade in conjuction with the device of the present invention;

FIG. 19 is a fragmentary view in plan showing a typical motor-driven blade assembly;

FIG. 20 is a side elevational view of the motorized device of FIG. 18; and

FIG. 21 is a schematic view greatly enlarged correlated to FIGS. 14 through 17, illustrated the various positions of the hair cutting blade in relation to the hair and the head from which it projects.

DESCRIPTION OF THE PREFERRED EMBODIMENT

Turning first to FIGS. 1–4, the hair cutting and trimming device of the invention comprises a body portion designated generally by the numeral 2 and constituting an arcuate plate 3 having a concave surface 4, a front edge 6, and a rear edge 7. The top surface 8 of the plate is also preferably convex and parallel to the concave surface 4, as illustrated. While the body portion has been illustrated as being fabricated from plastic, it will, of course, be understood that other suitable materials may be used.

Mounted on the top convex surface 8 of the body 2 is a handle 9 adapted for digital manipulation as will herinafter be explained. Also mounted on the body portion adjacent the front edge 6 and constituting projections on opposite long edges 12 and 13 of the body portion, are integral lugs 14 and 16, respectively, each integral with the body portion 2 and extending therefrom past the concave surface 4 to provide a mounting means for a blade support bridge 17 secured to the lugs 14 and 16 by appropriate pins 18 embedded in the lugs as illustrated best in FIG. 4.

The height of the lugs 14 and 16 is proportioned so that the blade mounting bridge 17 lies spaced from the concave surface 4 of the body portion 2, as illustrated in FIGS. 7 and 8. There is thus formed, between the lugs 14 and 16, the blade support bridge 17 and the concave surface 4, an elongated and generally rectangular channel or passageway designated generally by the numeral 19 (FIG. 7), and having projecting thereinto, as an integral part of the body portion, a plurality of lands 21 defining grooves 22 therebetween (FIGS. 7–9), for purposes which will hereinafter be explained.

At the opposite end of the body portion 2 there is provided a pair of integral abutments 23 next adjacent the rear edge 7 of the body portion, and forming the terminal end of a pair of ribs 24 and 26, which are integrally formed on the top surface 8 of the body portion 2 and extend longitudinally along the edges 12 and 13, respectively. Each rib 24, 26 is provided with teeth 27 on the mutually facing surfaces of the ribs as shown in FIG. 2.

Also formed on the top surface of the body portion of the hair cutting and trimming device is a set of indicia designated generally by the numeral 28 and constituting the numerals "0," "1," "2" and "3," these numbers being correlated to lines 29 embossed or engraved in the top surface 8 of the body portion 2 and having a correlation to the position of a comb structure designated generally by the numeral 31, which is mounted on the concave side 4 of the body portion 2.

The comb structure 31 includes a base section 32 (FIG. 2) which may be a metal bar which extends transversely across the concave face 4 of the body portion 2 of the device, and in which are embedded a multiplicity of longitudinally extending and arcuate tines 33. The tines 33 may be fabricated from metal or plastic. In a device in which the base section 32 is plastic, it is preferable that the tines 33 be integral with the base section 32, the two parts being conveniently injection molded as a single unit.

Where the base section 32 is a metal bar, as shown herein, the base portions 34 of the tines 33 may be suitably embedded and permanently retained in appropriate bores formed in the forward edge 36 of the base section 32. The tines 33, whether fabricated from metal or plastic, are substantially parallel to one another and extend away from the base section 32 in a smooth curve which conforms to the curvature of the arcuate surface 4 of the body portion 2 under which the comb structure 31 lies.

To retain the comb structure 31 in close proximity to the under concave surface of the body portion 2, there is provided a strap 37 (FIG. 2) suitably attached through appropriate screws not shown to the base section 32 and which, at opposite ends, is provided with perpendicular arm sections 38 and 39 which project upwardly on opposite sides of and in close proximity to the edges 12 and 13 of the body portion 2, and which are integral with mutally extending tab portions 41 and 42 that extend horizontally across the ribs 24 and 26 in substantial parallelism with the strap 37.

The tabs 41 and 42 are provided with re-entrant legs 43 and 44 which terminate in outwardly extending, serrated flanges 46 and 47, the serrations in the flanges 46 and 47 being adapted to engage the teeth 27 formed on the mutually facing surfaces of the ribs 24 and 26 as shown in FIGS. 2 and 3. It will thus be seen that, because of the attachment of the strap 37 to the underside of the base section 32, and because the integral portions of the strap 37, namely, portions 39, 42, 44 and 47 encompass the opposite longitudinal edges of the body portion, the comb structure is prevented from separating from the body portion, while sufficient clearance is provided in the space between the tabs 41 and 42 and the top surface of the associated ribs 24 and 26 to permit movement of the comb structure in relation to the body portion.

It will thus be seen that the tines 33 extend cantilever fashion away from the base section 32, and while being fabricated so that the tines 33 lie substantially parallel to one another, it is expedient that during movement of the comb structure in relation to the body portion, the tines 33 can be guided in such movement so as to maintain such parallelism. To effect such guidance, each of the tines is proportioned to pass through the channel 19 (FIG. 7–9) so that each of the tines is confined within one of the grooves 22 by a pair of adjacent lands 21.

Thus, to effect movement of the comb structure in relation to the body portion, all that is required is that the user grasp the resilient tabs 41 and 42 and squeeze them somewhat so that their displacement disengages the serrated flanges 46 and 47 from the teeth 27 formed in the ribs 24 and 26. Thereafter, all that is required is that the user, with one hand, retain the body portion stationary, as by holding onto the handle 9, while with the other hand he squeezes the tabs 41 and 42 to effect disengagement and simultaneously pushes either to the left or to the right as viewed in FIG. 2, to effect movement of the comb structure to the left or to the right as desired.

It will, of course, be understood that because the curvature of the comb structure closely conforms to the curvature of the concave surface 4, movement of the comb structure into its completely retracted position, as illustrated in FIG. 14, will subtend the shortest chord between the extreme ends 48 of the tines and rear edge 7 of the body portion 2. In this position of the parts, the flanges 46 and 47 will engage the abutments 23 adjacent the rear edge 7 of the body portion, and the leading edges of arms 38 and 39 will be in alignment with the indicia lines 29, specifically that line designated by the numeral "0."

In this position of the parts, the comb structure 31 is substantially completely retracted and contained within the curvature formed by the concave surface 4 of the body portion 2. This position of the parts also represents the shortest length to which hair may be generally be cut when the device is being utilized in a hair cutting and trimming mode.

On the other hand, if it is desired that the hair be cut at a greater length, the tabs 41 and 42 are again squeezed together, and the comb structure 31 is moved to the left as viewed in FIGS. 1 and 2 so that the comb structure slides along the concave surface into ony one of the other alternate positions indicated by the numerals "," "2," or "3." In these alternate positions, as illustrated schematically in FIGS. 14 through 17, the effect of such adjustment of the comb in relation to the body portion is to cause an extension of the tines 33 so as to increase the length of the chord subtended by the arc formed by the body portion and the extended tines and therefore increases the length of the arc subtended by the chord. It should be understood that while specific settings have been indicated by the indicia 29, the comb may be positioned at any intermediate position, as desired.

To effect cutting of the hair in whatever position the comb is placed in relation to the body portion, there is mounted on the blade support bridge 17, a blade 51 having a razor sharp edge 52, and provided with a pair of spaced apertures 53 and 54, as shown. The blade support bridge is provided with complementarily positioned studs designated generally by the numeral 56. Each stud includes a relatively large diameter base portion 57 integral with a relatively smaller diameter shank portion 58, on top of which is integrally formed a head 59 as shown in FIGS. 4 and 7 through 9.

To mount the blade 51, it is positioned over the blade support bridge 17 so that the apertures 53 and 54 coincide with the studs 56, and the blade 51 is dropped into position surrounding the base portion of the studs 56 and lying on the associated surface of the blade support bridge 17. To lock the blade in position, a resilient lock plate 61 is provided having key hole slots 62 formed therein, including a hole portion 63 and a slot portion 64, the hole portion 63 corresponding in size with the apertures 53 and 54, while the slot 64 coincides in proportions to the reduced-in-diameter shank portion of the stud 56.

To lock the blade 51 to the blade support bridge 17, the lock plate 61 is dropped over the studs 56 and pressed firmly to effect a resilient displacement of the center portion of the lock plate 61 and is moved longitudinally so that the slots 64 engage under the heads 59 of the studs. Preferably, one edge of the blade lock plate 61 is provided with serrations 66 which project toward the cutting edge of the blade to lend support to this portion of the blade, as illustrated in FIG. 4.

It will thus be seen that the hair cutting and trimming device of the invention may be used in at least three different modes. In a first mode, the device is set to a specific height and the comb then caused to pass through the user's hair, cutting the hair to whatever height the device has been set. Alternatively, in a second mode, pressure may be maintained on the tabs 41 and 42 so as to permit free sliding movement of the comb in relation to the body portion, in which case the device may be used as illustrated in FIG. 21 wherein the hair is tapered at the nape of the neck by holding the comb stationary in relation to the head while moving the body portion and hair cutting blade from a first position having the longest chord to the fully retracted position having the shortest chord. The movement of the blade from the most extended position to the retracted position follows a path designated in FIG. 21 by the line 67 so that the hair will be cut along this line to produce a taper.

Thirdly, the device may be used to produce a shaving action at the nape of the neck by exposing the edge 52 of the cutting blade 51 in a position just beyond the extreme ends 48 of the tines. Since this is a somewhat delicate operation and requires care because of the danger of cutting one's self with the razor-sharp edge, the abutments 23 normally prevent the blade from being thus exposed beyond the tines. However, to effect the shaving action, the tabs 41 and 42 are squeezed to a greater extent than is necessary to merely release the comb structure from the body portion of the device, the flexure being effected to such an extent that the flanges 46 and 47 clear the end edges of the abutments 23, permitting the complete retraction of the comb structure within the body portion and the projection of the blade beyond the ends 48 of the tines. This operation continued to its extreme will also result in disassembly of the comb structure from the body portion for purposes of cleaning the device.

To elevate the hair to facilitate cutting, it has been found that a smooth tine has the effect of causing the hair to lay flat against the head. In this position there is great difficulty in cutting the hair because it lays matted and difficult for the blade to cut through the mass. Accordingly, as illustrated in FIGS. 11, 12 and 13, in the preferred embodiment, the tines 33 of the device are provided with recesses or notches 71, each of which provides a shoulder 72 having a forward rake which has the effect of "grasping" the hair strands and retaining them in an elevated position as the tines 33 are drawn through the hair.

To effect the operation of the device as illustrated in FIG. 21 to produce a taper cut at the nape of the neck, it is expedient that the device be used as illustrated in FIG. 10, in which the user faces one mirror 73 while holding the device behind his head, with the ends 48 of the tines properly positioned at the hairline. The proper positioning of the tines may be viewed in the mirror 74. Once the device is properly positioned, and the hair engaged by the tines, the tabs 41 and 42 are grasped firmly between the thumb and the index finger of one hand, while the handle 9 of the device is held in the other hand. All that is required then is that while the end of the tines 48 are held in fixed position at the hairline, the body portion 3 on which the blade 51 is mounted be caused to move downwardly relative to the comb structure so that the blade is brought into cutting contact with the hair as illustrated in FIG. 21.

Although experimentation has shown that a fixed blade is quite satisfactory for cutting and trimming the hair, it is, of course, contemplated that, rather than a fixed blade, a motor driven, reciprocating blade 76, reciprocated by an appropriate motor 77, may be attached to the studs 56 in the same manner that the fixed blade is attached thereto. This construction is illustrated in FIGS. 18 through 20, and as there shown, the blade 76 is retained by a resilient lock plate 78 having a key hole slot 79 similar to the plate 61 so as to lock the blade in position while permitting attachment of the lock plate 78 to the motor 77 for reciprocation of the blade 76 thereby. In all other respects, the structure illustrated in FIGS. 18 through 20 is similar to the structure previously described, and corresponding reference numbers have been applied to corresponding parts.

Having thus described the invention, what is claimed to be new and novel and desired to be covered by letters patent by the United States is as follows:

I claim:

1. A hair cutting and trimming device, comprising:

a. a body portion having a concave surface defining one side thereof;

b. a comb structure mounted on said body portion for selective movement relative thereto and including a base section and a multiplicity of arcuate tines projecting cantilever fashion from said base section, the curvature of said arcuate tines complementing the curvature of said concave surface of said body portion;

c. a hair cutting blade mounted on said body portion and disposed on the side of said times remote from said body portion; and d. means for locking said comb structure to said body portion to adjust the position of said hair cutting blade in relation to said tines to control the height to which the hair is cut when said blade is moved in relation to the hair.

2. The combination according to claim 1 in which said body portion comprises an arcuate plate having a convex surface parallel to said concave surface.

3. The combination according to claim 1 in which said locking means includes resilient detent means associated with said base section of said comb structure and at least one row of notches formed on said body portion cooperating with said resilient detent means to lock said comb structure and body portion in a selected relationship.

4. The combination according to claim 1 in which said comb structure is selectively movable in relation to said body portion from a position of complete retraction in which said comb structure lies included within the curvature of said arcuate surface to a position of complete extension in which the tines of said comb structure project beyond the associated edge of the body portion in an extension of the arc formed by said concave surface.

5. The combination according to claim 1 in which means are provided on the tines of said comb structure for retaining the hair drawn through said comb structure in elevated position to facilitate cutting of the hair by the blade.

6. The combination according to claim 1 in which said body portion is provided with a blade support bridge extending transversely across said concave surface of said body portion and spaced therefrom to provide an elongated transversely extending channel through which said tines extend.

7. The combination according to claim 2 in which a pair of elongated parallel ribs are provided along opposite edges of said plate on the convex side thereof, the mutually facing surfaces of said ribs being serrated, and said locking means comprises oppositely disposed resilient tabs secured to the base section of said comb structure and including re-entrant portions normally resiliently engaging said serrations to lock said comb structure to said body portion while permitting selective flexure of said tabs to unlock said comb structure and enable movement thereof relative to said body portion.

8. The combination according to claim 6 in which a pair of studs project from said blade support bridge and extend through said blade, each said stud having a relatively large diameter base portion, a relatively smaller shank portion, and a head formed on said relatively smaller shank portion, and a lock plate adapted to overlie the blade and releasably lock under the heads of said studs to lock the blade to the blade support bridge.

9. The combination according to claim 6 in which lands and grooves are formed on said body portion projecting into the passageway underlying the blade support bridge to be engaged by said tines to maintain the parallelism thereof.

10. The combination according to claim 7 in which stop means are provided normally restricting movement of said comb structure relative to said body portion in a direction of complete retraction of said comb structure whereby said comb structure cannot inadvertently be disassembled from said body portion while permitting intentional disassembly therefrom.

11. A hair cutting and trimming device, comprising:

a. a body portion having a concave surface defining one side thereof;

b. a comb structure mounted on said body portion for selective movement relative thereto and including a base section and a multiplicity of arcuate tines projecting cantilever fashion from said base section, each tine having a plurality of transverse notches for retaining and elevating hair strands;

c. a hair cutting blade mounted on said body portion and disposed on the side of said tines remote from said body portion; and d. means for locking said comb structure to said body portion to adjust the position of said hair cutting blade in relation to said tines to control the height to which the hair is cut when said blade is moved in relation to the hair.

12. The combination according to claim 11 in which said body portion comprises an arcuate plate having a convex surface parallel to said concave surface.

13. The combination according to claim 11 in which said locking means includes resilient detent means associated with said base section of said comb structure and at least one row of notches formed on said body portion cooperating with said resilient detent means to lock said comb and body portion in a selected relationship.

* * * * *